US008607841B2

(12) United States Patent
Hayashiguchi

(10) Patent No.: US 8,607,841 B2
(45) Date of Patent: Dec. 17, 2013

(54) ROLL SCREEN DEVICE

(75) Inventor: Norio Hayashiguchi, Tsu (JP)

(73) Assignee: Hayashiguchi Mfg Co., Ltd., Mie (JP)

( * ) Notice: Subject to any disclaimer, the term of this patent is extended or adjusted under 35 U.S.C. 154(b) by 0 days.

(21) Appl. No.: 13/392,542

(22) PCT Filed: Jun. 24, 2011

(86) PCT No.: PCT/JP2011/064553

§ 371 (c)(1),
(2), (4) Date: Apr. 26, 2012

(87) PCT Pub. No.: WO2012/176332

PCT Pub. Date: Dec. 27, 2012

(65) Prior Publication Data

US 2012/0325416 A1 Dec. 27, 2012

(51) Int. Cl.
*E06B 9/58* (2006.01)

(52) U.S. Cl.
USPC ..... 160/273.1; 160/376

(58) Field of Classification Search
USPC ..... 160/273.1, 272, 271, 376
See application file for complete search history.

(56) References Cited

U.S. PATENT DOCUMENTS 4,610,293 A * 9/1986 Weiblen ..... 160/120
5,526,865 A * 6/1996 Coenraets ..... 160/272
6,119,758 A * 9/2000 Coenraets ..... 160/273.1
7,389,807 B2 * 6/2008 Nagare et al. ..... 160/273.1
7,665,506 B2 * 2/2010 Coenraets ..... 160/266
7,793,702 B2 * 9/2010 Biewer et al. ..... 160/370.22
7,841,377 B2 * 11/2010 Coenraets ..... 160/268.1
8,037,921 B2 * 10/2011 Dondlinger et al. ..... 160/268.1
2009/0145559 A1 6/2009 Glasl et al.

FOREIGN PATENT DOCUMENTS

| | | |
|---|---|---|
| JP | 6-10591 | 2/1994 |
| JP | 2001-107666 | 4/2001 |
| JP | 2004-211298 | 7/2004 |
| JP | 2008-520859 | 6/2008 |

* cited by examiner

*Primary Examiner* — David Purol
(74) *Attorney, Agent, or Firm* — Wenderoth, Lind & Ponack, L.L.P.

(57) ABSTRACT

In a roll screen device, inner rails are embedded inside fixed guide rails which guide protrusions at side edges of a screen which is wound via a take-up shaft. Each inner rail has a guide groove in which the guide protrusion is inserted, and inward flanges are provided at an opening of the guide groove. Rail members have outer side protrusions and inner side protrusion of different heights at both side edges of a rail base plate. The higher outer side protrusions are confronting. A micro gap extends between the lower inner side protrusions into the guide groove such that the micro gap is opposed to a guide gap formed between the opposed inward flanges. The guide protrusion is slid and guided in a come-off preventing state by the inner side protrusion, so that an extremely thin fastener element can be used as the guide protrusion.

4 Claims, 5 Drawing Sheets

ROLL SCREEN DEVICE

TECHNICAL FIELD

The present invention relates to a roll screen device which is used at a time of opening and closing an opening daylighting part, an opening portion or the like of a building.

BACKGROUND ART

As this kind of roll screen device, a structure described in Japanese Unexamined Patent Publication No. 2001-107666 has been conventionally known. This roll screen device is structured such that a screen is taken up by a take-up shaft, an inner rail is embedded into an inner portion of each of a pair of opposed guide rails which guide a movement of both side edge portions of the screen taken out of the take-up shaft, the inner rail is provided with a guide groove to which a guide protrusion provided along both side edge portions of the screen and being capable of being taken up spirally is movably inserted, a pair of inward flanges are formed in an opening end portion of the guide groove, and the guide protrusion is slid and guided in a come-off preventing state by a pair of inward flanges.

In the roll screen device as mentioned above, in general, a fastener tape in a slide fastener is overlapped with a side edge portion of the screen so as to be firmly fixed by a high frequency welder, and a fastener element which is provided along one side edge of the fastener tape is set to the guide protrusion.

In the roll screen device as mentioned above in which the fastener element is set to the guide protrusion, in the case where a thickness of the fastener element serving as the guide protrusion is thicker than a thickness of the screen, in the spirally winding state of the screen by the take-up shaft, the guide protrusions overlap with each other and winding diameters of both end portions become larger than a winding diameter of a center portion, whereby the screen is taken up like a double headed conical shape and a crease is generated in both end portions, or the guide protrusion is taken up so as to be displaced in a width direction of the screen with respect to the previously taken up guide protrusion and the screen winds its way, so that a resistance at a time of taking up becomes great, and it is impossible to smoothly take up.

In order to solve the problem mentioned above in the roll screen device described in Japanese Unexamined Patent Publication No. 2001-107666, the thickness of the screen is made thicker than the thickness of the guide protrusion, thereby preventing the guide protrusions from being taken up in an overlapping manner.

In the meantime, in the conventional roll screen device, since the thickness of the screen is made thicker than the thickness of the guide protrusion although the screen can be extremely finely taken up, the screen comes to a heavy load, and can not be smoothly taken up while requiring great operating force for taking up. Further, if the screen is long, the roll screen device must be large in size, and an applicable range of the roll screen device becomes narrow, so that there is left a point to be improved on an expansion of the applicable range.

In this case, in recent years, as the fastener tape, a structure in which the tape thickness is about 0.35 mm, and the fastener element set to the guide protrusion is extremely thin about 1.0 mm has developed and is going to be produced. The inventor of the subject case has found that a clean take-up state can be obtained without enlarging a winding diameter in both end portions even in the thin screen by employing the extremely thin fastener tape as mentioned above, and has intended to employ the fastener tape for the roll screen device, but could not employ it due to the following problems.

In other words, the inner rail which guides the movement of the fastener element serving as the guide protrusion is formed of molded synthetic resin, a gap which guides the movement of the fastener tape is provided between opposed portions of the pair of inward flanges, in an inner portion in which the inward flanges are formed, no gap exists in an outer portion in an opposite side, and the outer portion of the inner rail contracts so as to be curved in a width direction after being formed, due to the presence/absence of the gap. Further, since an amount of contraction is not uniform, it is impossible to absolutely secure a guide gap having such a size that can prevent the fastener element from coming off, more particularly, a guide gap of about 0.7 mm, between the opposed surfaces of the pair of inward flanges.

Therefore, if tensile force directed to an inner side in a width direction is applied to the screen at a time of inserting the guide protrusion into the guide grove formed in the inner rail, and sliding and guiding the guide protrusion by the pair of the inward flanges, the guide protrusion gets out of the gap between the pair of inward flanges, and it is impossible to prevent the guide protrusion from coming off.

SUMMARY OF THE INVENTION

An object of the present invention is to provide a roll screen device in which a fastener element of an extremely thin fastener tape can be employed as a guide protrusion in both side edge portions of a screen which is taken up by a take-up shaft, so as to achieve an enlargement of an applicable range.

In order to achieve the object mentioned above, in accordance with this invention, in a roll screen device in which a guide protrusion capable of being spirally taken up is provided in both side edge portions of a screen which is taken up to an outer periphery of a take-up shaft by a rotation in one direction of the take-up shaft, an inner rail which is constructed of molded synthetic resin is embedded into an inner side of a pair of fixed guide rails which guide a movement of both the side edge portions of the screen rewound from the take-up shaft, a guide groove which guides the movement of the guide protrusion is provided in a length direction of the inner rail, the roll screen device sliding and guiding in a state of preventing the guide protrusion from coming off by a pair of opposed inward flanges which are provided in an opening end of the guide groove, there is employed a structure in which a slide guide rail is embedded into a guide groove of the inner rail, the slide guide rail is constructed by a pair of rail members which are resin-molded, the rail member is provided with an outer side protrusion having a height which is approximately one half a groove width of the guide groove in one side portion of a band plate shaped rail base plate having a width which is approximately equal to a groove depth of the guide groove, and provided with an inner side protrusion which is lower than the outer side protrusion and is higher than the inward flange in another side portion, the pair of rail members are combined such that the outer side protrusions are confronted, and a slit-like micro gap is formed between the opposed portions of the inner side protrusion, and are embedded into the guide groove in such a manner that the micro gap is opposed to a guide gap formed between the opposed portions of the inward flange, and the guide protrusion is slid and guided in a come-off preventing state by the inner side protrusion.

It is possible to form the slit shaped micro gap between the opposed portions of a pair of inner side protrusions, by setting a pair of the rail members which are provided with the inner side protrusion and the outer side protrusion having different heights in both the side portions of the rail base plate, to the combination in which the higher outer side protrusions are opposed, as mentioned above. Further, it is possible to form a guide groove which is communicated with the micro gap between the opposed portions of the pair of rail members.

At this time, since the pair of rail members forming the micro gap have approximately the uniform thickness over a whole while being formed approximately as a C-shaped form in a cross sectional shape, a deformation is hardly generated due to a contraction after the resin molding, and it is possible to resin-mold the rail member having a high dimensional precision.

Accordingly, it is possible to absolutely form, between the pair of inner side protrusions, the micro gap which is smaller than the guide gap formed between the opposed portions of the pair of inward flanges, by making the height of the inner side protrusion lower than the height of the outer side protrusion and higher than the height of the inward flange.

As a result, it is possible to employ the fastener element of the extremely thin fastener tape mentioned above as the guide protrusion, it is possible to employ a thin film shaped structure as the screen, and it is possible to provide the roll screen device having a wide applicable range.

In this case, it is preferable that the synthetic resin serving as the forming raw material of the rail member is hard. As the resin mentioned above, a vinyl chloride and a polycarbonate can be employed.

In this invention, since a pair of molded resin rail members which are provided in both side portions of the rail base plate with the inner side protrusion and the outer side protrusion having the different heights are embedded, as the combination in which the higher outer side protrusions are opposed, into the guide groove of the inner rail, as mentioned above, it is possible to absolutely form, between the opposed portions of the pair of inner side protrusions, the micro gap which is smaller than the guide gap formed between the opposed portions of the pair of inward flanges, and it is possible to absolutely slide and guide the thin guide protrusion in a come-off preventing state by the pair of inner side protrusions. As a result, since it is possible to employ the fastener element of the extremely thin fastener tape as the guide protrusion, and it is possible to employ the thin film shaped structure as the screen, it is possible to provide the roll screen device having a wide applicable range.

DETAILED DESCRIPTION OF THE INVENTION

Figure 1:
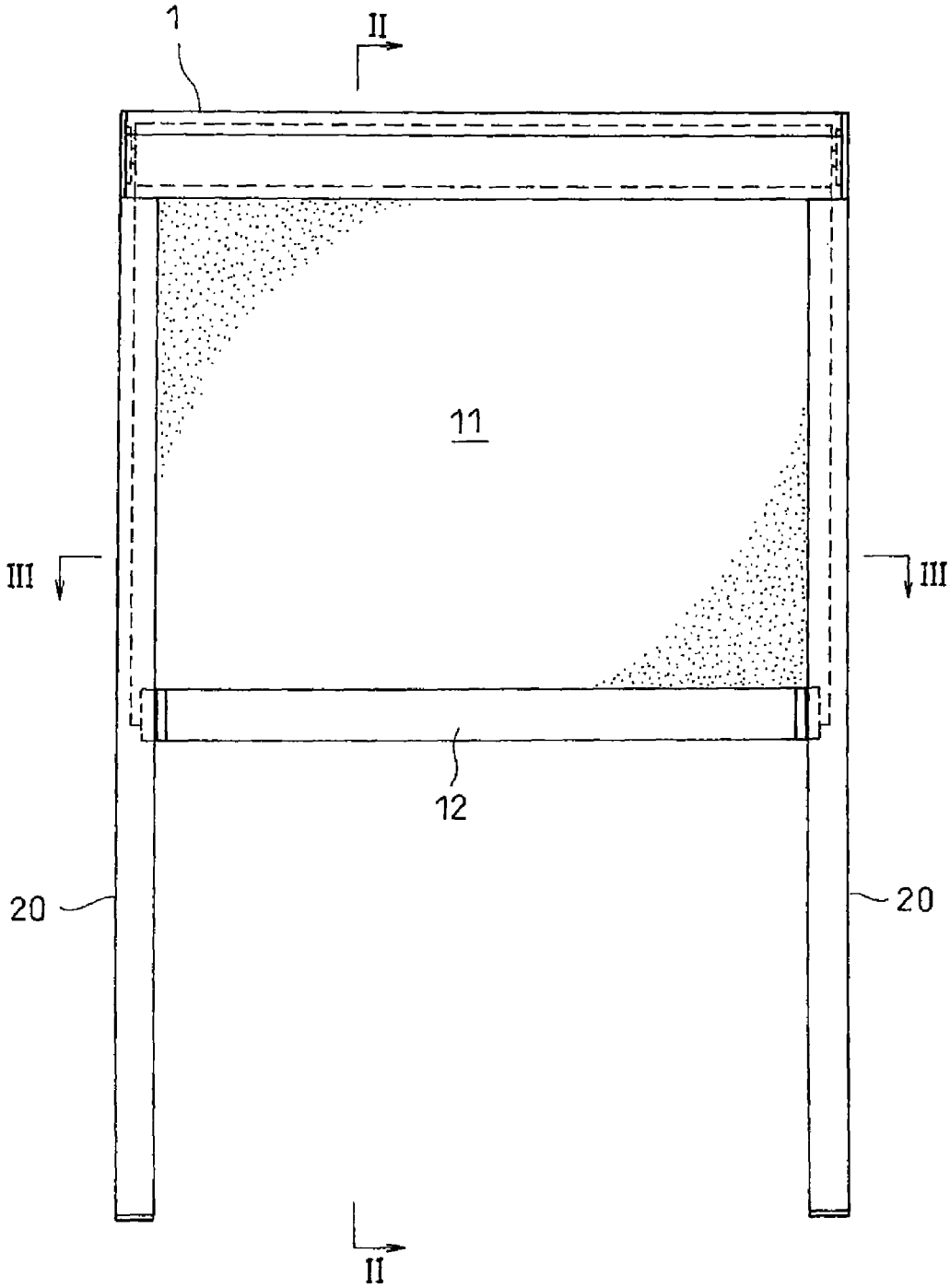
FIG. 1 is a front elevational view showing an embodiment of a roll screen device in accordance with this invention.

A description will be given below of an embodiment of the present invention based on the accompanying drawings. As shown in FIG. 1 to FIG. 4, a bottom plate 2 of a screen storage box 1 formed as a rectangular tubular shape is provided with an outlet port 3 which is elongated in both right and left end directions.

A take-up shaft 10 is embedded in an inner portion of the screen storage box 1. One end portion of a screen 11 is connected to the take-up shaft 10. The screen 11 is taken up and rewound by a rotation of the take-up shaft 10. At a time of rewinding, the screen 11 is protuded downwardly through the outlet port 3 formed in the bottom plate 2 of the screen storage box 1, and is provided at its lower end with a weight bar 12 which applies a tensile force in a length direction of the screen 11.

Further, guide protrusions 13 are respectively provided on both side edge portions of the screen 11. Each. guide protrusion 13 is constructed by a fastener element which is attached to a side edge portion of a fastener tape 14 of a slide fastener, and the fastener tape 14 provided with the fastener element is overlapped with a side edge portion of the screen 11 so as to be firmly fixed and integrated.

In this case, the take-up shaft 10 is structured so as to be rotationally driven by a motor 15 which is embedded in an inner portion thereof, but may be structured so as to rotate the take-up shaft in a rewinding direction by a drawing-out operation of the screen 11 caused by a pull-down operation of the weight bar 12, thereby making a coil spring which is embedded in the inner portion of the take-up shaft generate a torsional deformation, and making the take-up shaft rotate in a winding direction with a restoring elasticity of the coil spring.

Figure 2:
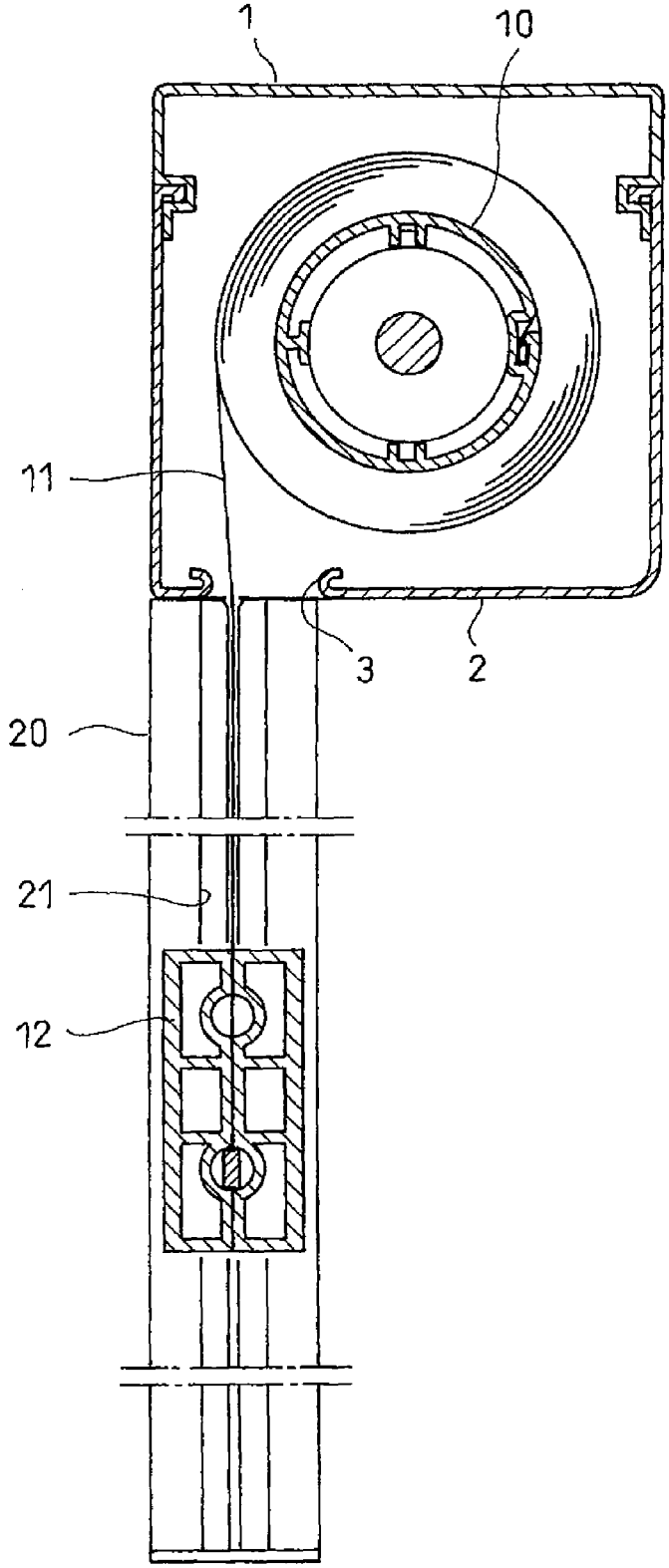
FIG. 2 is a cross sectional view along a line II-II in FIG. 1.

As shown in FIG. 1 and FIG. 2, respective upper end portions of a pair of guide rails 20, which are arranged so as to be opposed laterally and be elongated in an up and down direction, are connected to both end portions of a lower surface of the screen storage box 1.

Figure 3:
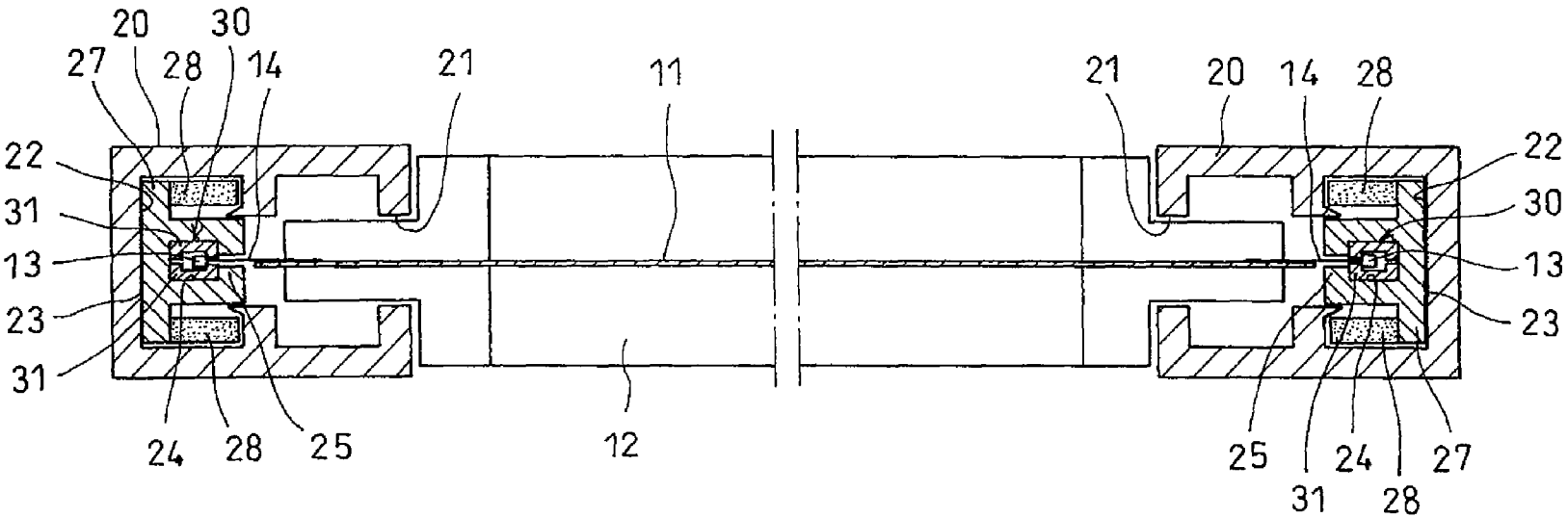
FIG. 3 is a cross sectional view along a line III-III in FIG. 1.
Figure 4:
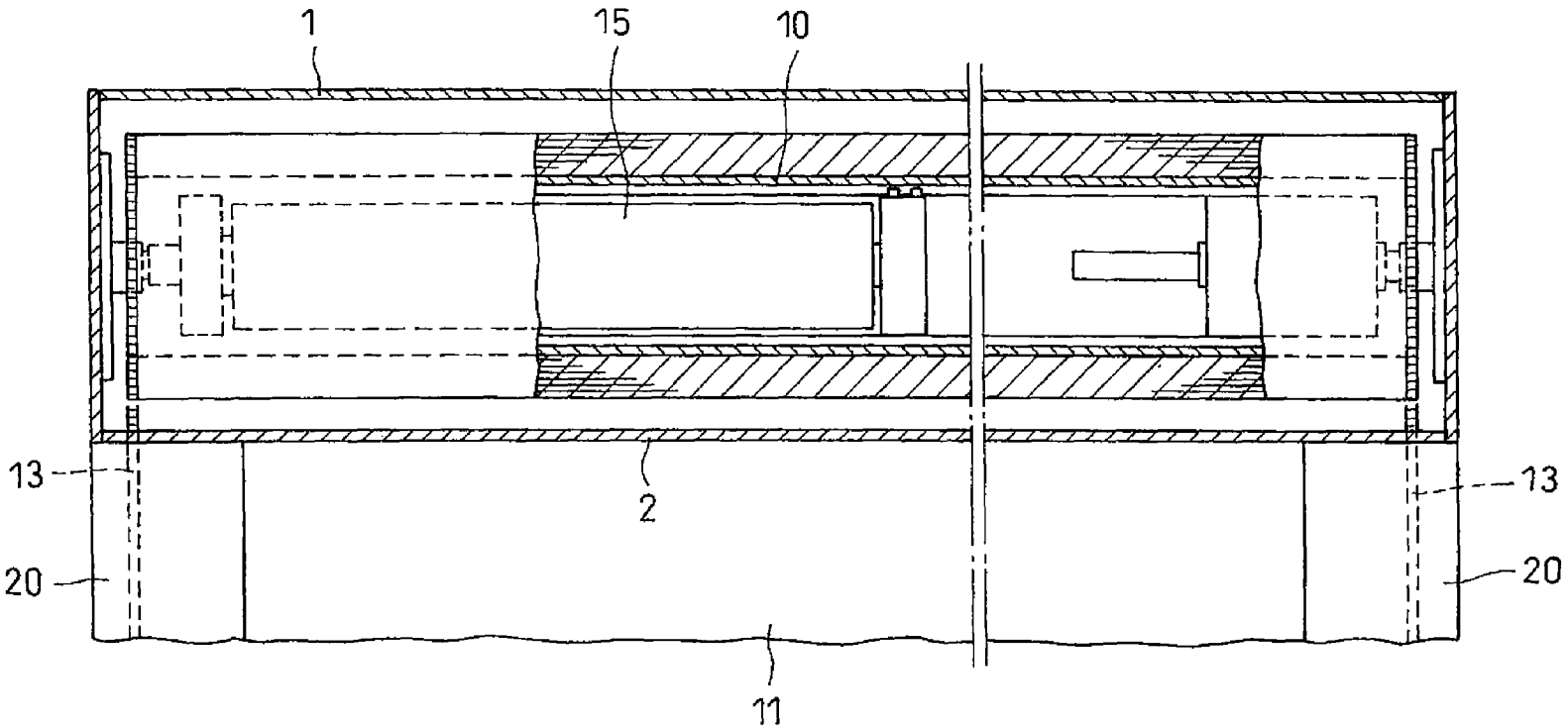
FIG. 4 is a partly cut cross sectional view showing an embedded portion of a take-up shaft.

As shown in FIG. 3, in the guide rails 20, there are formed insertion grooves 21 which open through opposed surfaces of the guide rails 20, and rail storage spaces 22 which are communicated with the insertion grooves 21. The insertion grooves 21 and the rail storage spaces 22 are elongated in a longitudinal direction (up and down direction) of the guide rails 20. Upper end openings of the insertion grooves 21 are respectively opposed to both ends of the outlet port 3 of the screen storage box 1, and both end portions of the weight bar 12 are slidably fitted into the insertion grooves 21.

Figure 5:
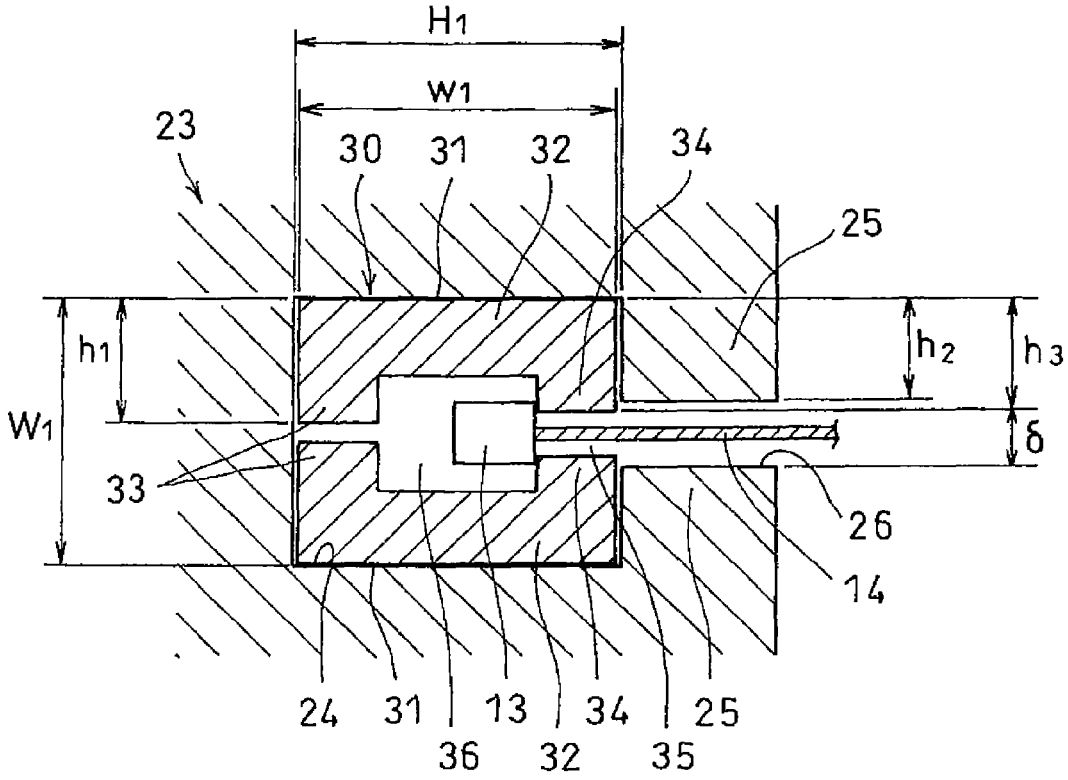
FIG. 5 is a cross sectional view showing a part of FIG. 3 in an enlarged manner.

An inner rail 23 is embedded in an inner portion of each rail storage space 22. The inner rail 23 is set to the same length as the guide rail 20. As shown in FIG. 3 and FIG. 5, a guide groove 24 to which a side edge portion of the screen 11 can be inserted is formed in each inner rail 23, and a pair of inward flanges 25 are formed in an opening end portion of the guide groove 24.

Each inner rail 23 is constructed of a molded synthetic resin, and a guide gap 26 is formed between opposed surfaces of the pair of inward flanges 25. Reference symbol δ shown in FIG. 5 denotes the size of the guide gap 26, and the size is set to be approximately 1.0 mm which is a limit of a resin molding of the inner rail 23.

A slide guide rail 30 is fitted into the guide groove 24 of each inner rail 23. Each slide guide rail 30 is constructed by a pair of rail members 31. Each rail member 31 is constructed of a molded synthetic resin and has an outer side protrusion 33 provided at one side portion of one surface of a rail base plate 32, and an inner side protrusion 34 formed at another side. A width (lateral dimension) w1 of each rail base plate 32 is made approximately equal to a groove depth (lateral dimension) H1 of the guide groove 24 formed in the inner rail 23.

Further, a height (width dimension) h1 of each outer side protrusion 33 is made approximately one half a groove width (width dimension) W1 of the guide groove 24 in the inner rail 23. Further, a height (width dimension) h2 of each inner side protrusion 34 is lower (smaller) than the height (width dimension) h1 of the outer side protrusion 33 and is higher (width dimension) than a height (width dimension) h3 of the inward flange 25.

Each pair of rail members 31 is formed as such a combination that the outer side protrusions 33 are confronted, and a slit-like micro gap 35 is formed between the opposed portions of the inner side protrusion 34, the pair of rail members 31 are embedded into the guide groove 24 in such a manner that the micro gap 35 is opposed to a guide gap 26 formed between the opposed portions of the inward flange 25, and the pair of rail members 31 are prevented from coming off by the pair of inward flanges 25 which are provided in an opening end of the guide groove 24.

Further, with the combination as mentioned above of the pair of rail members 31, a guide groove 36 is formed between the opposed portions of the pair of rail members 31, and in the case where the screen 11 is drawn out of the take-up shaft 10, the fastener tape 14 provided in both the side edge portions of the screen 11 is guided by the micro gap 35 of the slide guide rail 30, and the guide protrusion 13 is inserted to the guide groove 36 so as to be slid and guided in a come-off preventing state by a pair of inner side protrusions 34.

As shown in FIG. 3, a bulge portion 27 protruding back and forth is formed in an outer surface in each inner rail 23, and an elastic body 28 such as a sponge or the like is embedded between inner walls of the bulge portion 27 and the guide rail 20. The elastic body 28 is structured so as to bias the inner rail 23 toward an outer side so as to apply a tension in a width direction to the screen 11.

In the embodiment, since each pair of rail members 31, which are provided with the outer side protrusions 33 and the inner side protrusions 34 having the different heights in the one surface of the rail base plate 32 and are made of the synthetic resin, are formed as the combination in which the higher outer side protrusions 33 are opposed, as mentioned above, it is possible to form the micro gap 35 which guides the movement of the fastener tape 14, between the pair of opposed inner side protrusions 34. Further, it is possible to form the guide groove 36 which is smaller in a cross sectional shape than the guide groove 24 of the inner rail 23, between the opposed portions of the pair of rail members 31.

At this time, since the pair of rail members 31 forming the micro gap 35 are approximately uniform in their thickness over a whole while being formed as a C-shaped form in their cross sectional shapes, it is possible to resin-mold the rail member 31 having a high dimensional precision in which deformation by contraction after the resin molding is extremely small.

Accordingly, it is possible to form, between the pair of inner side protrusions 34, the micro gap 35 which is smaller than the guide gap 26 formed between the opposed portions of the pair of inward flanges 25, by making the height h2 of the inner side protrusion 34 lower than the height h1 of the outer side protrusion 33, and higher than the height h3 of the inward flange 25.

As a result, it is possible to employ the fastener element of the fastener tape in which the tape thickness is about 0.35 mm, and the fastener element is extremely thin at about 1.0 mm, as the guide protrusion 13, and it is possible to employ a thin film shaped structure as the screen 11. Therefore, it is possible to provide the roll screen device having a wide applicable range.

The invention claimed is:

1. A roll screen device comprising:

a screen configured to be wound onto and from a take-up shaft, said screen having laterally opposed side edges;

guide protrusions secured along the laterally opposed side edges, respectively, of the screen;

a pair of fixed guide rails disposed on laterally opposite sides of said screen to receive and guide said guide protrusions, respectively, said fixed guide rails extending in a longitudinal direction to guide the guide protrusions and the screen along the longitudinal direction, and said fixed guide rails respectively defining therein rail storage spaces and longitudinally-extending insertion grooves opening from said rail storage spaces laterally inwardly toward one another such that said guide protrusions can respectively pass through said insertion grooves into said rail storage spaces and said screen can extend laterally through said insertion grooves with said guide protrusions disposed in said rail storage spaces;

molded synthetic resin inner rails respectively disposed in said rail storage spaces of said fixed guide rails, each of said inner rails defining therein a guide groove, and a pair of inward flanges that project inwardly toward each other to define a guide gap therebetween that extends in a longitudinal direction and opens laterally so as to align with a respective one of said insertion grooves of said fixed guide rails; and slide guide rails respectively disposed in said guide grooves of said inner rails, each of said slide guide rails being constituted by two separate longitudinally elongated molded resin rail members, each of said rail members including a rail base plate, an outer side protrusion projecting from a laterally outer side of said rail base plate, and an inner side protrusion projecting from a laterally inner side of said rail base plate, said outer and inner side protrusions of each rail member projecting in a same direction such that each of said rail members is substantially C-shaped in cross section with said inner protrusions of the two rail members facing each other to form a longitudinally extending micro gap therebetween and with said outer protrusions of the two rail members facing each other, and such that a longitudinally extending guide groove is defined between the two C-shaped rail members with the micro gap opening laterally from said guide groove to align with the guide gap of the respective inner rail and the insertion groove of the respective fixed guide rail;

wherein said guide grooves of said inner rails each have a lateral dimension (H1) that is substantially equal to a width dimension (W1) thereof in a width direction perpendicular to the lateral and longitudinal directions so as to be substantially square in cross section;

wherein said outer protrusions of said rail members of each of said slide guide rails have width dimensions (h1) that are each substantially one-half the width dimension (W1) of the guide groove of the respective inner rail;

wherein, for each of said fixed guide rails, said guide groove of said inner rail has inner walls that face each other in the width direction, and said inward flanges of said inner rail respectively extend toward each other in the width direction by a projection amount (h2) beyond the respective inner wall such that the width dimension (h1) of the respective outer protrusion is larger than the projection amount (h2);

wherein, for each of said fixed guide rails, said projection amount (h2) of each of said inward flanges is larger than a width dimension (h3) of the inner side protrusion of the respective rail member; and wherein, for each of said fixed guide rails, said insertion groove of said fixed guide rail, said guide gap of the respective inner rail and said micro gap of the respective slide guide rail are in communication with one another.

2. The roll screen device according to claim 1, wherein said molded resin rail members are formed of hard synthetic resin.

3. The roll screen device according to claim 2, wherein wherein said hard synthetic resin is one of a vinyl chloride and a polycarbonate.

4. The roll screen device according to claim 1, wherein said guide groove and said micro gap of each of said slide guide rails, as well as each of said guide protrusions, are dimensioned such that said guide protrusions are retained in said guide grooves of said slide guide rails with said screen extending through said micro gaps.

* * * * *